US005915571A

United States Patent [19]

Czalkiewicz et al.

[11] Patent Number: 5,915,571

[45] Date of Patent: Jun. 29, 1999

[54] ANGULARLY TIERED MEDIA DISPLAY STRUCTURE WITH ADJUSTABLE POCKETS

[75] Inventors: Joseph Czalkiewicz, Brunswick; Edward O. Gandolf, Strongsville; Gary W. Beck, Chagrin Falls, all of Ohio; Kenneth Ray Stott, Union Mills, N.C.

[73] Assignee: American Greetings Corporation, Cleveland, Ohio

[21] Appl. No.: 08/906,196

[22] Filed: Aug. 5, 1997

[51] Int. Cl.[6] ..... A47F 5/00

[52] U.S. Cl. ..... 211/55; 211/128.1

[58] Field of Search ..... 211/55, 126.1, 211/126.2, 128.1, 133.1; 108/106

[56] References Cited

U.S. PATENT DOCUMENTS

| | | | |
|---|---|---|---|
| D. 161,451 | 1/1951 | Humpheries | 211/55 |
| 2,067,051 | 1/1937 | Hall | 211/55 |
| 2,938,634 | 5/1960 | Ganz . | |
| 3,139,186 | 6/1964 | George . | |
| 3,179,479 | 4/1965 | Freedman | 211/128.1 X |
| 4,083,456 | 4/1978 | Genn et al. . | |
| 4,099,813 | 7/1978 | Olivan . | |
| 4,588,094 | 5/1986 | Evans . | |
| 4,613,047 | 9/1986 | Bushyhead et al. . | |
| 4,801,023 | 1/1989 | Ecclestone . | |
| 4,817,900 | 4/1989 | Whittington et al. . | |
| 4,844,266 | 7/1989 | Small et al. . | |
| 4,896,779 | 1/1990 | Jureckson . | |
| 4,905,845 | 3/1990 | Broeker et al. . | |
| 4,925,038 | 5/1990 | Gajewski . | |
| 4,936,470 | 6/1990 | Prindle . | |
| 4,938,365 | 7/1990 | Conway et al. . | |
| 4,938,366 | 7/1990 | Carroll . | |
| 4,949,849 | 8/1990 | Hardy . | |
| 5,009,335 | 4/1991 | Jonker . | |
| 5,031,781 | 7/1991 | Price et al. . | |
| 5,085,328 | 2/1992 | Evenson . | |
| 5,226,266 | 7/1993 | Cernuto . | |
| 5,263,578 | 11/1993 | Narvey . | |
| 5,289,926 | 3/1994 | Lewis et al. . | |
| 5,328,037 | 7/1994 | Fujii . | |
| 5,344,030 | 9/1994 | Evenson . | |
| 5,720,396 | 2/1998 | Wegscheid et al. | 211/55 |

*Primary Examiner*—Robert W. Gibson, Jr.
*Attorney, Agent, or Firm*—Calfee, Halter & Griswold LLP

[57] ABSTRACT

An angularly tiered media display structure with adjustable pockets includes a frame having a plurality of tiers at different angles throughout a vertical extent of the display. The frame supports channeled shelves at each tier. Product display pockets are slidably engaged in the channeled shelves to support and display products such as planar media at varying angles through the vertical extent of the display. The tiers are vertically spaced to maximize exposure of the products in each row.

20 Claims, 9 Drawing Sheets

ANGULARLY TIERED MEDIA DISPLAY STRUCTURE WITH ADJUSTABLE POCKETS

FIELD OF THE INVENTION

The present invention pertains generally to support structures and, more particularly, to structures for supporting and displaying objects at retail and, even more particularly, to structures for supporting and displaying generally planar objects such as printed media including magazines, newspapers, books, cards, packaged multi-media and the like.

BACKGROUND OF THE INVENTION

Retail display structures are typically designed to support products in high density and exposure. The retail display of magazines and other printed media is particularly problematic with respect to adequate retention of multiple copies on a plurality of shelves, and the amount of exposure of the front covers in each row. In a dense display of fifty or more different magazines the foremost rows or shelves of magazines substantially obscure the back rows, often to the extent that only the very tops of the covers behind the front row are exposed. This problem is somewhat reduced by increasing the vertical distance between rows, such as shown for example in U.S. Pat. No. 2,938,634. However, when this is done with shelves having an open front, the magazines can easily "dog-ear" and fall forward off the display, as the reduced amount of overlap of the magazine immediately in front does not help to retain the one behind it. Also, the angle at which the shelves are tiered is fixed throughout the vertical range of the display. U.S. Pat. Nos. 4,613,047; 4,905,845 and 4,949,849 each describe tiered media displays wherein the rows of shelves are angled away from the front at a fixed angle for the entire height of the display.

To address this problem, pockets have been devised which support magazines along a bottom edge and the side edges of the front cover. A plurality of pockets are attached to a rack or wall. U.S. Pat. No. 5,328,037 describes a magazine display rack having cooperating pocket halves attached to a vertically oriented slat wall. Although the pocket halves adequately retain the magazines, and may be adjustable in width by sliding the halves within a slot, the amount of exposure of the front covers is limited to the extent of vertical separation of the wall slats. In any type of rack or pocket attached to a vertical wall, as also shown in U.S. Pat. Nos. 4,817,900 and 4,844,266, the angle of presentation of the front covers in each row is the same throughout the vertical range of the display. This angle is optimum for viewing at only one particular height.

SUMMARY OF THE INVENTION

The present invention overcomes these and other disadvantages of the prior art by providing an adjustable tiered media display structure with a varying angle of orientation of media-supporting pockets throughout the vertical range of the display. In accordance with one aspect of the invention, there is provided a media display having a frame which supports a plurality of channeled shelves in angularly tiered rows, wherein each of the shelves is supported at a different angle with respect to a vertical plane of the display, and pocket halves which cooperate to form individual media pockets are slidably engaged in channels in the shelves.

In accordance with another aspect of the invention, a media display structure includes a frame for supporting a plurality of shelves in an angularly tiered arrangement wherein an angle of orientation of one shelf relative to a horizontal base of the frame is different from an angle of orientation of another shelf relative to the horizontal base of the frame, the shelves configured for engagement with a plurality of pocket halves, the pocket halves arrangable upon the shelves to form media supporting pockets oriented upon the display according to the angular orientation of the corresponding shelf.

In accordance with another aspect of the invention, there is provided an assembly for supporting and displaying objects, including a frame having two opposed end panels connected by rails, each end panel having a generally horizontal bottom edge on which the frame rests, a generally vertical back edge, and a front edge having a plurality of tiers of similar configuration but different angular orientation with respect to the horizontal edge or vertical edge of the panel, the tiers configured to support a channeled shelf, and pockets configured to be engageable with the channeled shelf for supporting and displaying objects within the pockets.

And in accordance with still another aspect of the invention, an angularly tiered retail display structure includes a frame having opposed end panels, each end panel having a bottom edge, a back edge and a front edge with multiple tiers, each tier being at a different angle relative to the bottom edge, each tier configured to support a product bearing assembly, whereby products are displayed in tiered rows at different angles throughout the vertical extent of the display.

These and other aspects of the present invention are herein described in particularized detail with specific reference to the accompanying Figures.

DETAILED DESCRIPTION OF PREFERRED AND ALTERNATE EMBODIMENTS

Figure 1:
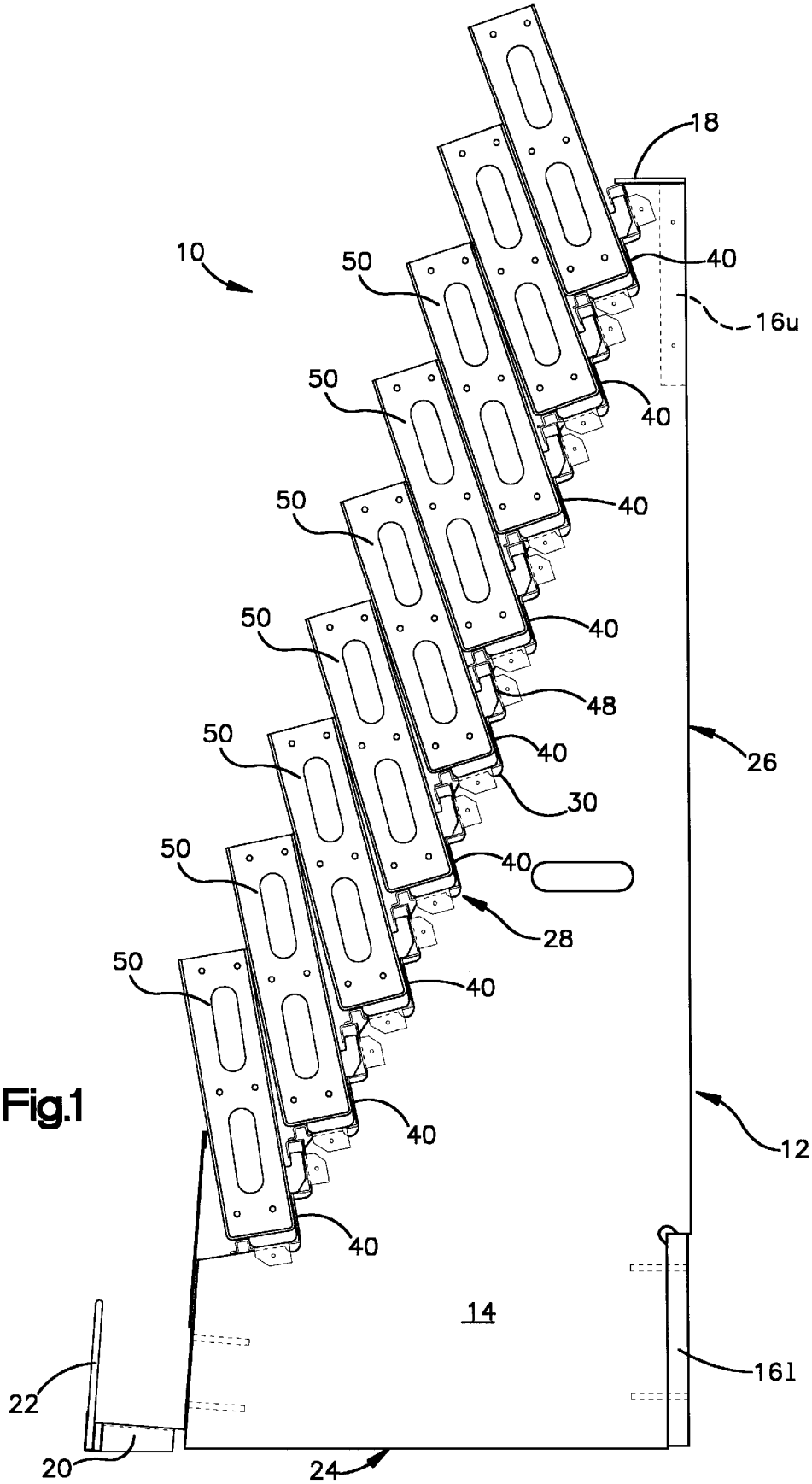
FIG. 1 is a side elevation of one embodiment of the media display structure of the present invention.
Figure 2:
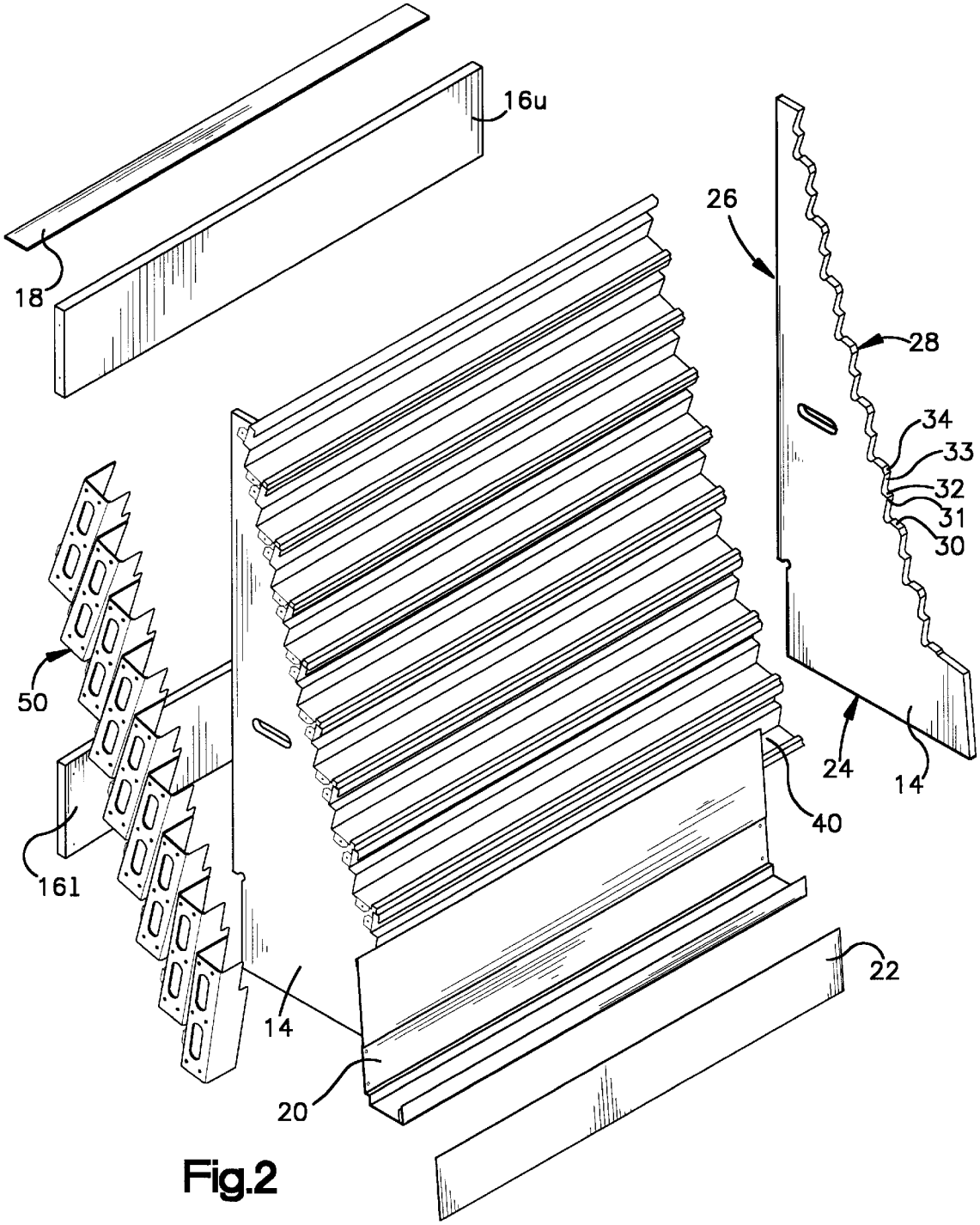
FIG. 2 is an exploded perspective assembly view of an embodiment of the media display structure of the present invention.

As shown in FIGS. 1 and 2, one embodiment of the adjustable pocket angularly tiered media display structure is indicated generally at 10. A frame 12 includes parallel opposing end panels 14 connected by upper and lower longitudinal rails 16*u* and 16*l*, a top cover 18, and a bottom shelf 20. A sham 22 is supported in the generally vertical position shown in FIG. 1 by a flange in the lower area of bottom shelf 20. The general profile of each of the matching end panels 14 includes a generally horizontal bottom edge 24, which provides a support base for the structure along with the bottom edge of the lower longitudinal rail 161, a generally vertical rear edge 26, and an angularly tiered front edge 28.

Figure 3:
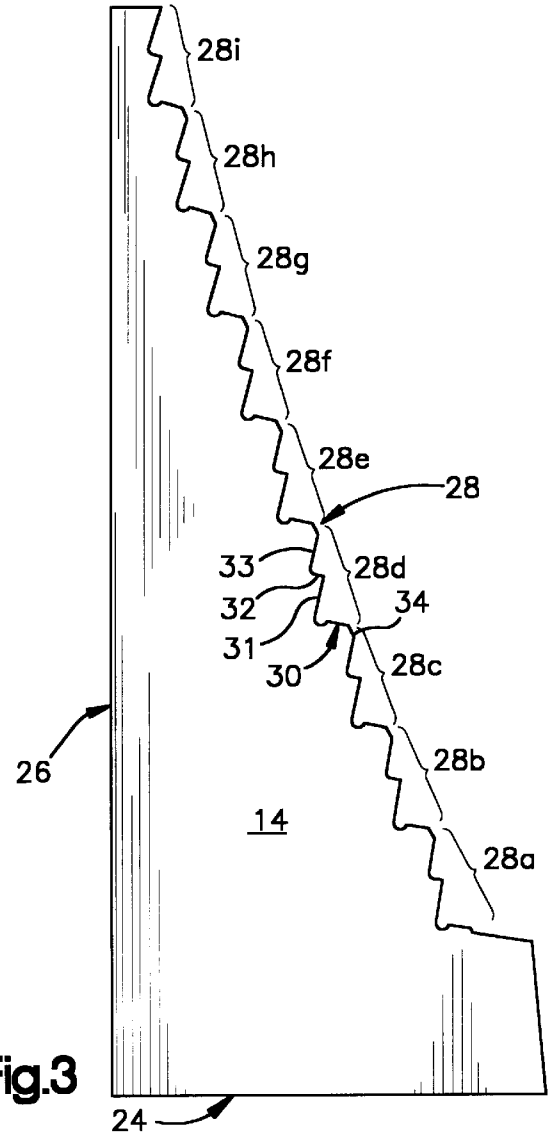
FIG. 3 is a side elevation of an end panel of the media display structure of the invention.

The profile of the angularly tiered front edge 28 of the end panels 14 is variable in accordance with the general principles of the invention, though is generally characterized by a slight angular variation of each of the successive tiers 28*a*–28*i* along the front edge 28. For example, as shown in isolation in FIG. 3, each tier 28*a*–28*i* of front edge 28 of end panel 14 includes a shelf supporting segment 30 which intersects generally perpendicularly with a first upright segment 31 which intersects generally perpendicularly with a channel-receiving segment 32 which intersects generally perpendicularly with a second upright segment 33. The second upright segment 33 intersects with the immediately superior shelf supporting segment 30, preferably about a chamfered edge 34. As apparent from FIGS. 2 and 3, each of the successive tiers 28*a*–28*i* of the front edge 28 of panels 14 is at a slightly different angular orientation with respect to edges 24 and 26. In this particular embodiment, the angle of the shelf supporting segments 30 increase with respect to bottom edge 24 as the distance of the tier from the bottom edge increases. However, it will be appreciated that within the scope of the invention the angular variation of the tiers relative to the frame and to the other tiers may vary in an increasing, decreasing order or at random, as further described below.

Figure 4B:
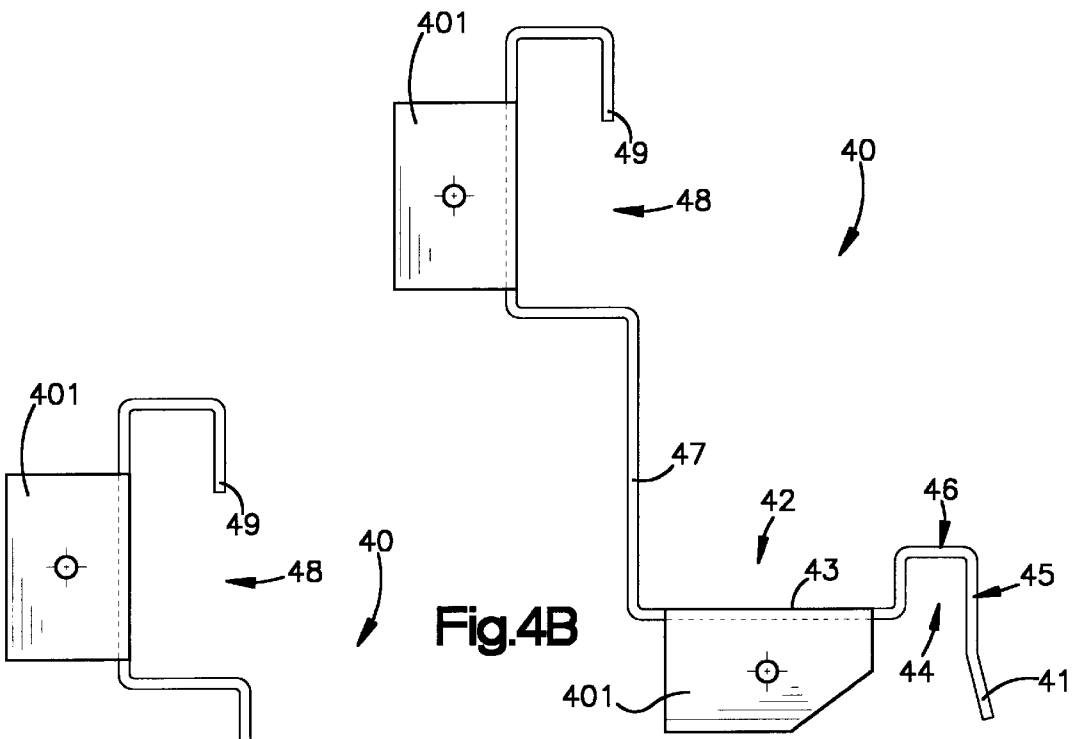
FIGS. 4A and 4B are end views of channeled shelves of the media display structure of the invention.
Figure 4A:
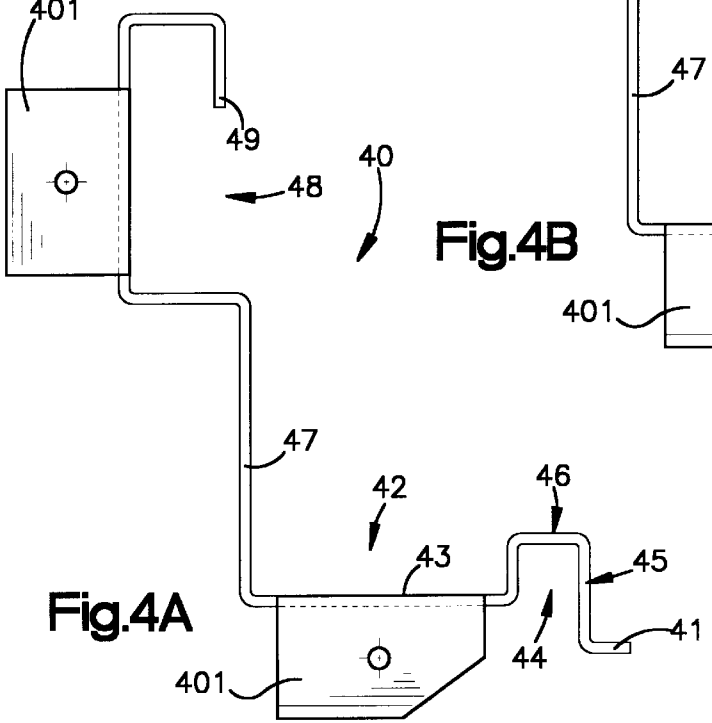

As shown in the isolated end views of FIGS. 4A and 4B, a channeled shelf 40 is generally configured to conform to and fit within the described profile of the tiers 28*a*–28*i*. The channeled shelf 40 includes a pocket supporting channel 42 having a channel floor 43 bordered along a front edge by an inverted channel 44. A front wall 45 of inverted channel 44 may extend downward below the pocket supporting channel 42, terminating in an outward flange 41. The outer top surface of the inverted channel 44 provides a secondary pocket support surface 46. A vertical section 47 extends upward from floor 43 to form a back wall to channel 42, and is connected at a top end to a pocket flange receiving channel 48. The front of the pocket flange receiving channel is formed by a downward lip 49. Attachment flanges 401 are formed perpendicular to the shelves at the ends to overlap be fastened to the end panels. As shown in FIG. 4B, the outward flange 41 may be bent downward, for example on the bottom-most channeled shelf, to provide an extended point of contact with bottom shelf 20.

As shown in FIG. 1, one channeled shelf 40 is received in each tier, with the pocket supporting channel resting upon the shelf supporting segment 30 of the tier, and the pocket flange receiving channel 48 fits within the channel-receiving segment 32. The top of the pocket flange receiving channel 48 provides a support surface for the outward flange 45 of the immediately superior shelf 40. The shelves are angled or canted relative to a vertical axis of the display structure according to the angular orientation of the supporting tier. In the illustrated embodiment, the shelves 40 are canted forward at different angles. For example, tier 28*a* is oriented at a first canted forward position, and tier 28*b* is oriented at a second canted forward position, the angles of the first and second canted forward positions being different.

As shown in FIGS. 1, 5A–5C, 6 and 7A–7B, the display structure is completed by the addition of pocket halves 50 which are slidably engaged with the channeled shelves 40 in pairs of laterally opposed cooperating halves to form discrete compartments or pockets in which multiple copies of magazines or other printed media or objects are held for display. Each pocket half 50 includes a base panel 52, a front panel 54, a rear panel 56, and one side panel 58 along one edge of the base, front and rear panels. The cavity formed by the pocket halves in lateral opposition provides a product bearing assembly capable of supporting any type of three-dimensional product, and is ideally suited for supporting and displaying products of generally rectilinear configuration such as printed media. The front panel 54 extends the entire height of the pocket half to retain the edges of any paper or bound material from flopping forward. This aspect of the pocket halves is critical in retaining flexible media M such as magazines within the pockets, particularly in the embodiments of the invention wherein the pockets are canted forward upon the shelves. An upper area of the inside edge of panel 54 may be recessed to increase the exposure area of media M within the pocket, but with an appreciable amount of panel 54 extending to the top of the pocket half in order to fully retain the upper extreme outer corner Mc neatly within the pocket.

Figure 5A:
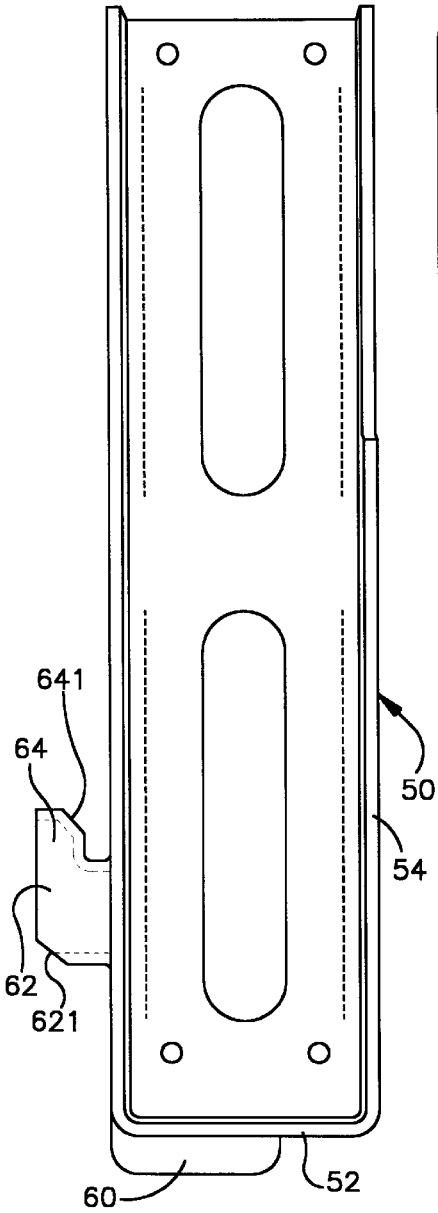
FIG. 5A is a side elevation of a pocket half of the media display structure of the invention.
Figure 5B:
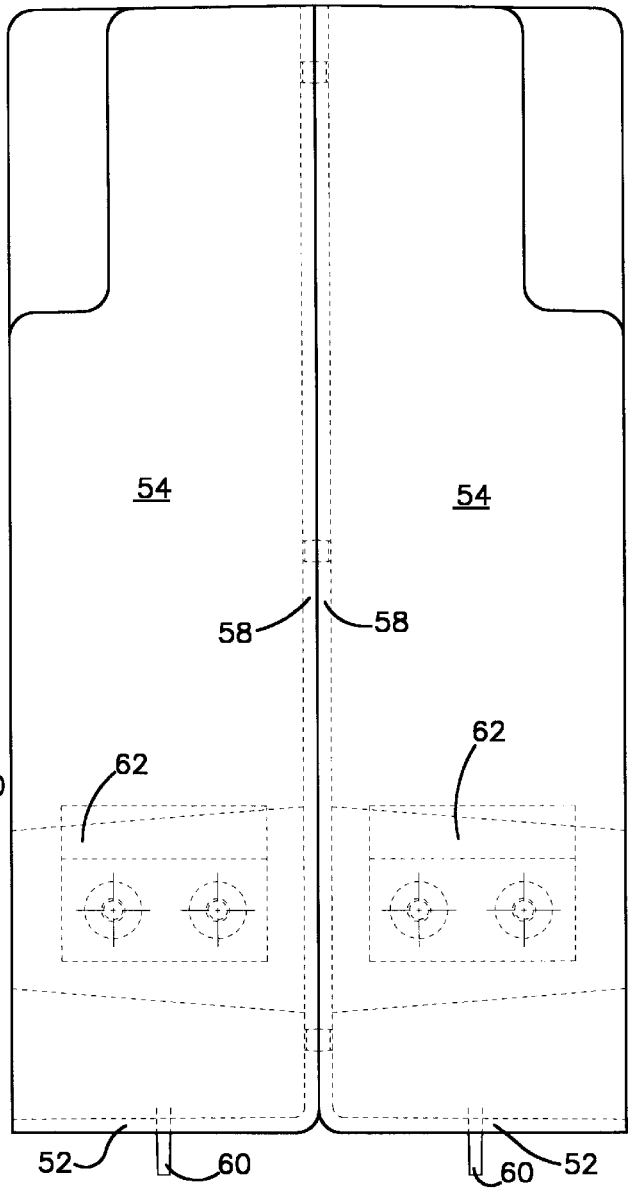
FIG. 5B is a frontal elevation of combined pocket halves of the media display structure of the invention.
Figure 5C:
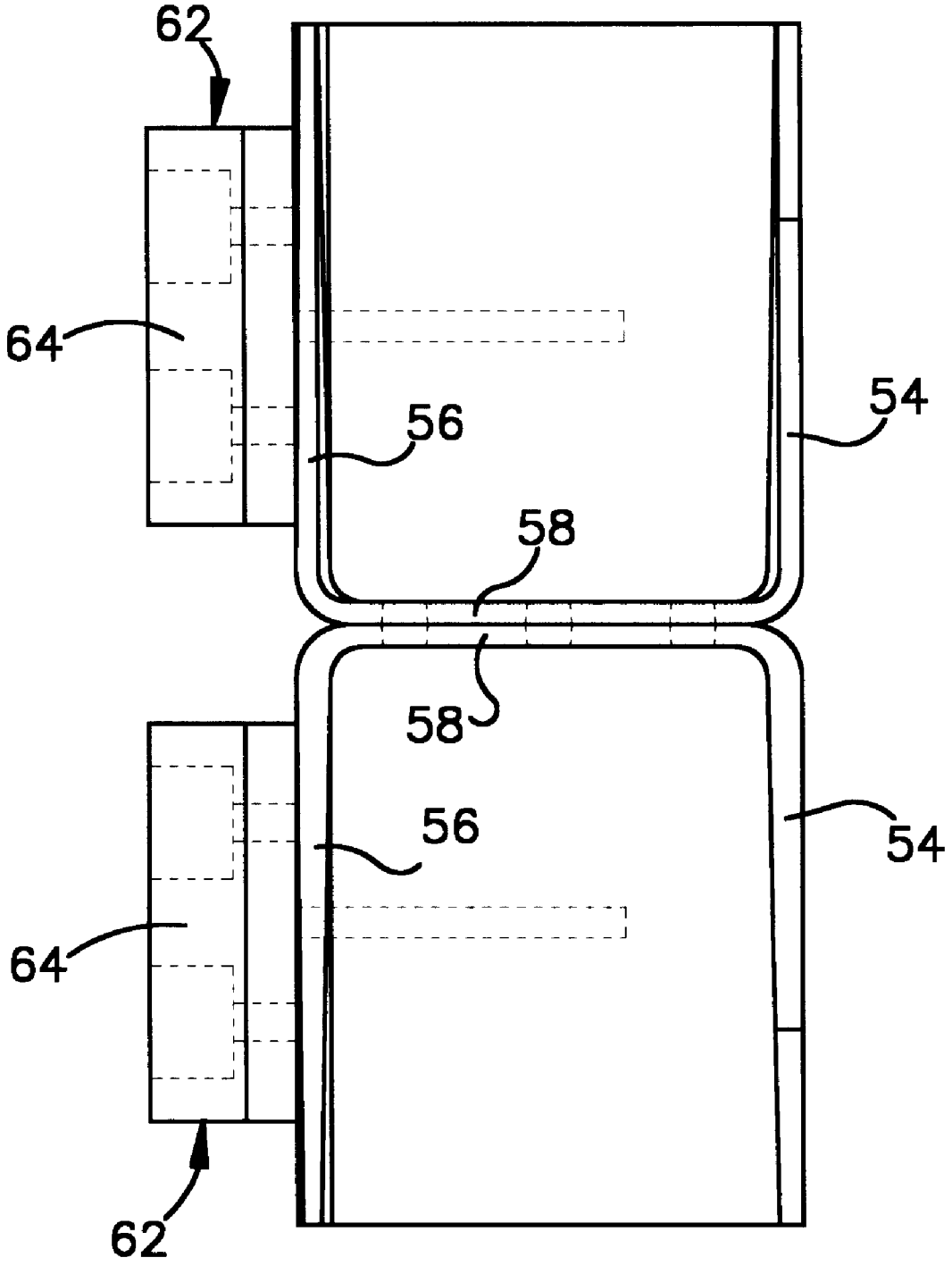
FIG. 5C is a top view of combined pocket halves of the media display structure of the invention.
Figure 6:
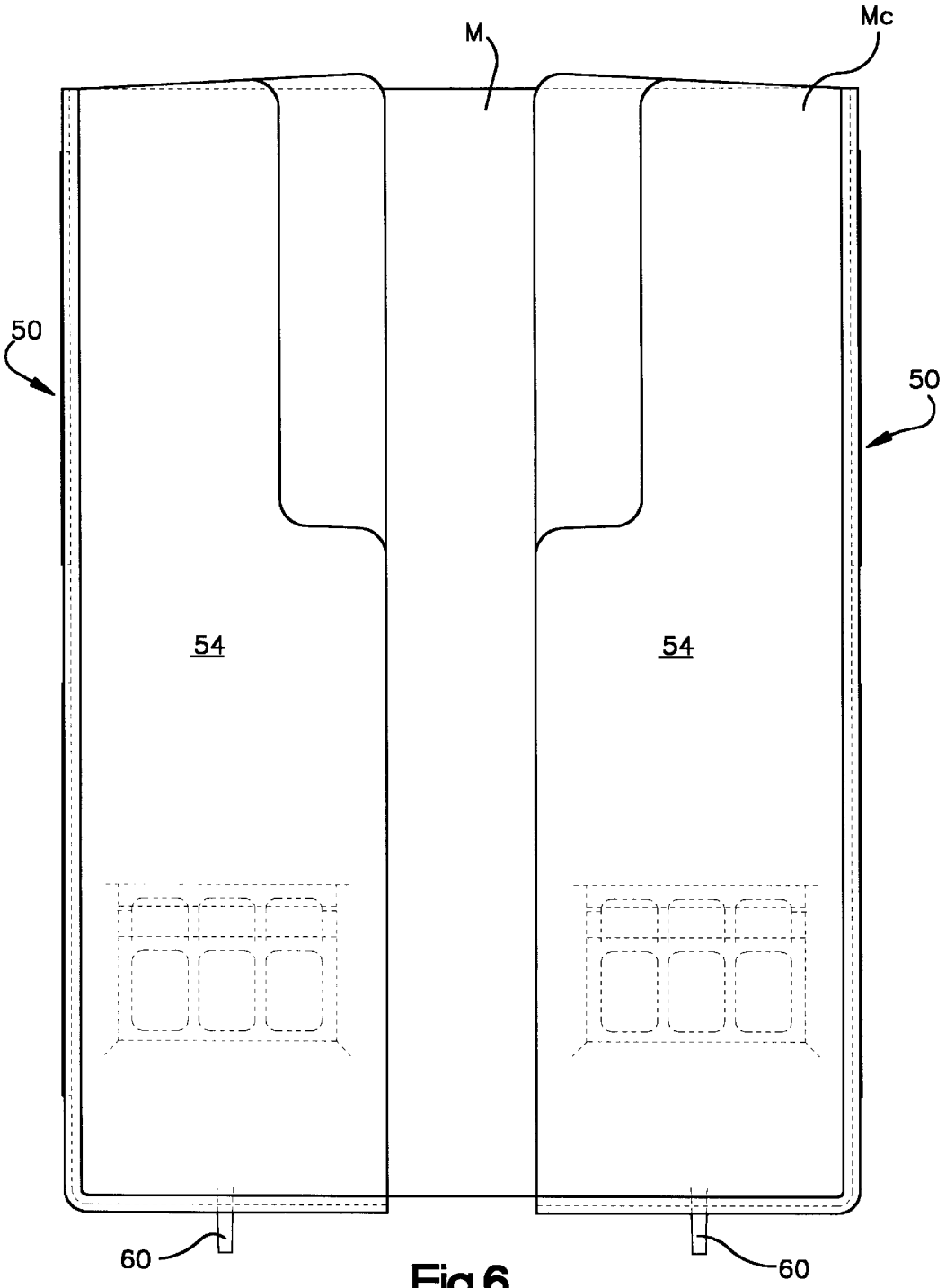
FIG. 6 is a frontal elevation of a media pocket formed by laterally opposed pocket halves.
Figure 7A:
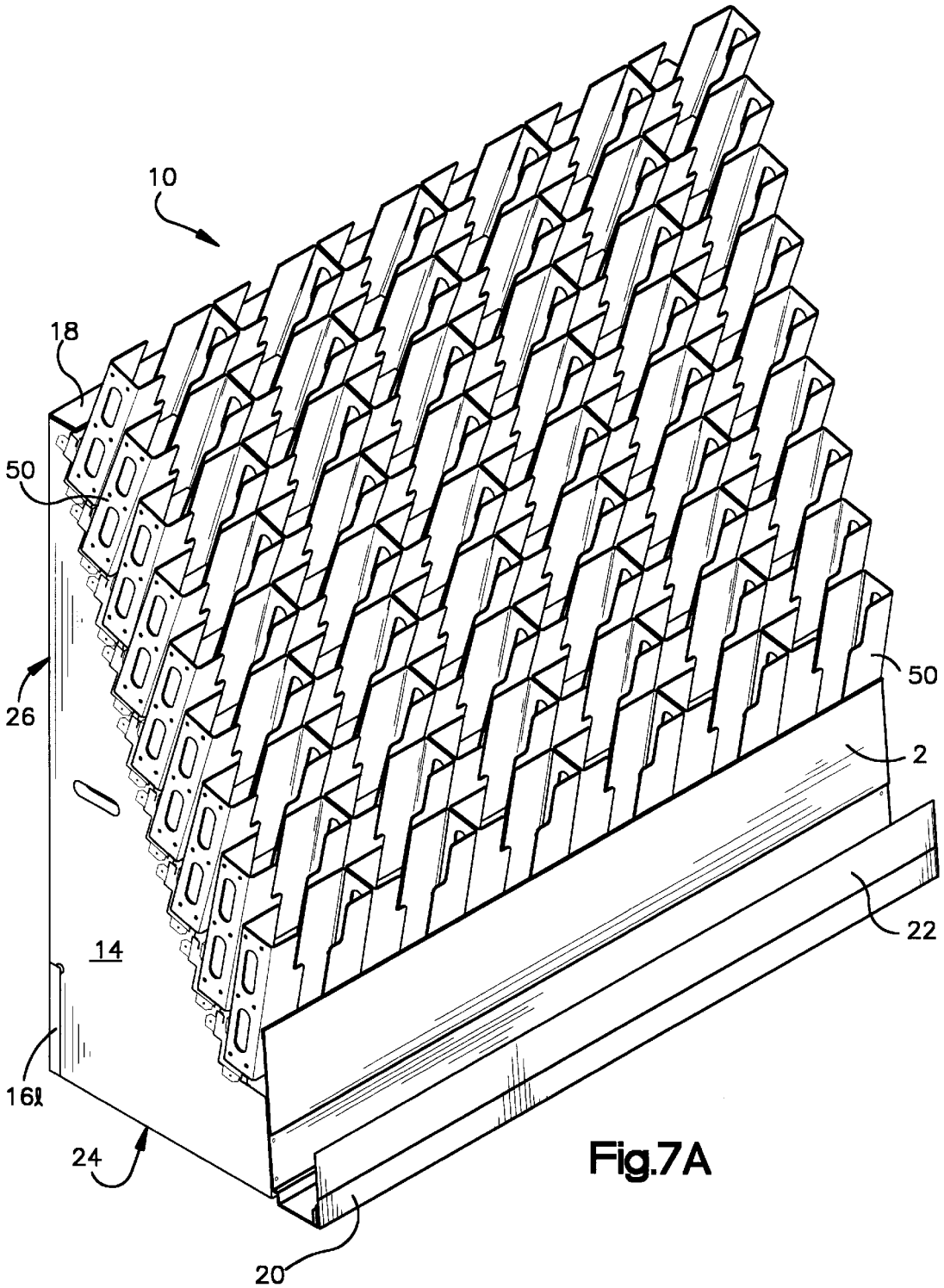
FIGS. 7A and 7B are a perspective views of the media display structure of FIGS. 1–6.
Figure 7B:
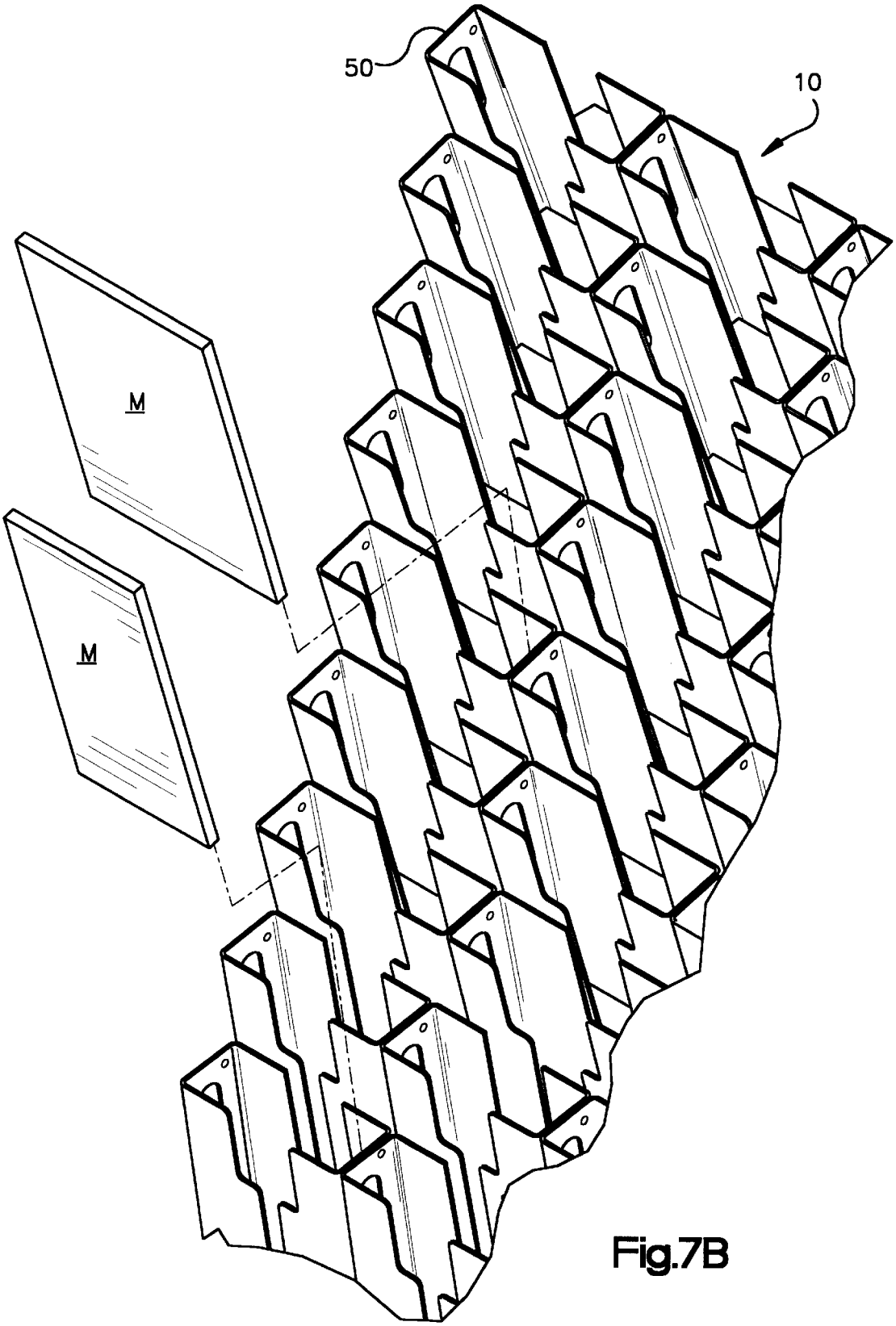

With continuing reference to FIGS. 5 and 6, a foot 60 extends from the exterior side of base panel 52 to an extent approximately equal to the depth of and dimensioned to fit within the pocket supporting channel 42 of shelf 40. A pocket mounting flange 62, dimensioned to fit within the pocket flange receiving channel 48 of shelf 40, extends from rear panel 56. As shown in FIG. 5A, the anterior and posterior comers of foot 60 are rounded or chamfered to avoid binding within channel 42 and to facilitate engagement and disengagement of the pocket half out of the open front of the channeled shelf 40. An interior edge 641 of a head 64 of mounting flange 62 is chamfered, as is bottom edge 621, also to facilitate frontal engagement and disengagement of the pocket half with respective channels of the channeled shelf 40. With the shelves angled forward as shown, the interior edge of the head 64 of the mounting flange contacts the interior side of the downward lip 49 of the pocket flange receiving channel 48 to retain the pocket at the desired angle upon the shelf.

The pocket halves 50 can be engaged and disengaged with the channeled shelves 40 through the open ends of the shelves (as shown in FIGS. 4A and 4B), or through the open front of the shelves by inserting the chamfered interior edge 641 behind lip 49 of the pocket flange receiving channel 48, and rotating the pocket half through the open front of the shelf so that the pocket foot 60 is positioned over the pocket supporting channel 42. The pocket half is then dropped slightly vertically within the shelf so that the pocket foot 60 rests within channel 42, and flange 64 remains behind lip 49. The process is reversed to disengage a pocket half from the shelf. The pocket halves in front of a pocket half to be inserted or removed can be laterally displaced within the shelves to provide the necessary clearance for the described engagement/disengagement. This avoids having to remove an entire shelf of pocket halves in order to add or remove pockets halves to change the density and size distribution of the display. As shown in the lower area of FIG. 7B, pockets or narrower width are formed by closer arrangement to accommodate media M of relatively narrower width.

As shown in FIGS. 5B and 5C, the pocket halves 50 can be joined together along the side panels 58 in opposed orientation to maximize the number of pockets upon a given shelf. The interior surface of the pocket receiving channel 42, and/or the secondary pocket support surface 46, may be lined with rubber or other suitable frictional material to retard lateral movement of the pocket halves within the shelves.

Figure 8:
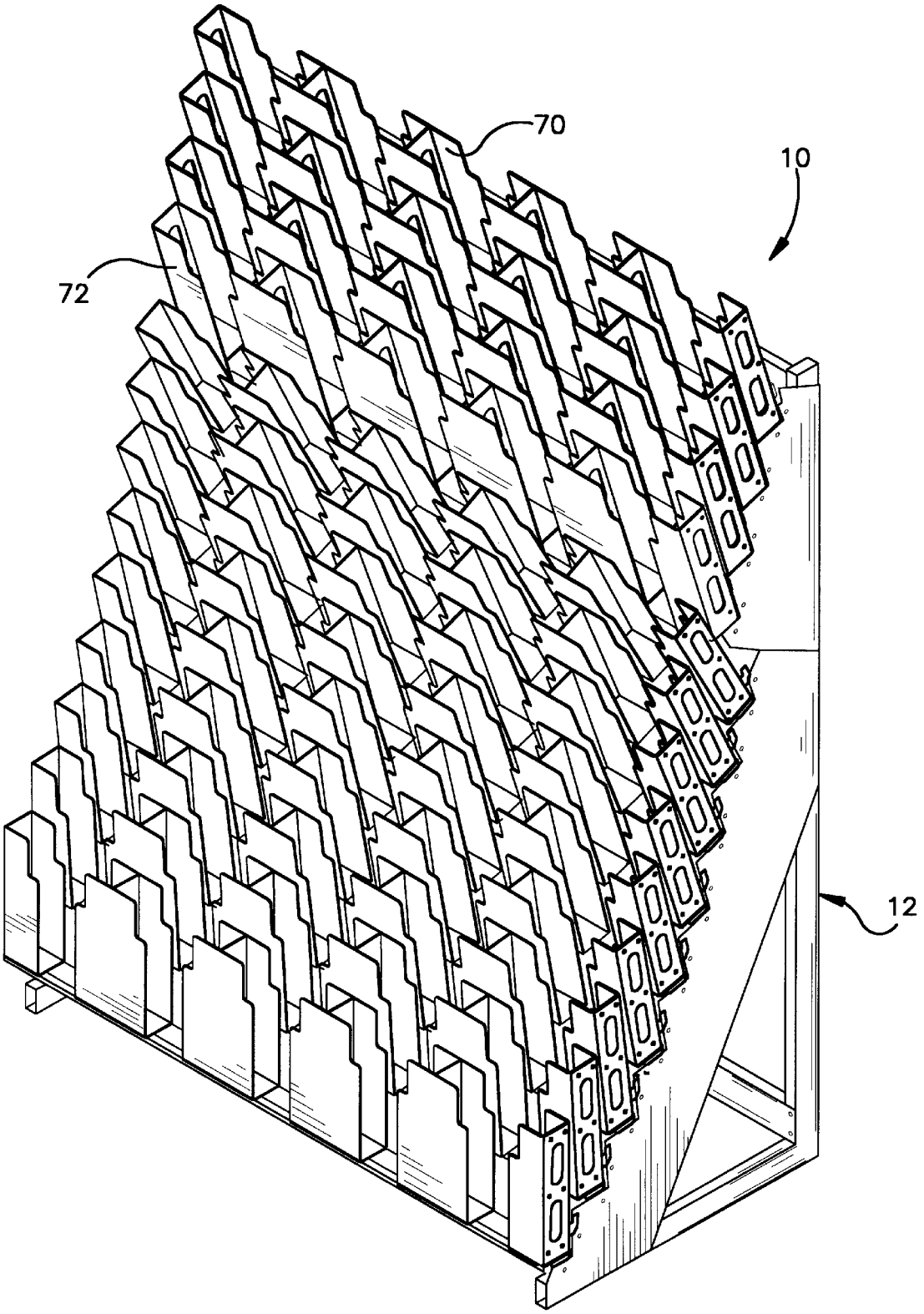
FIG. 8 is a perspective view of an alternate embodiment of a media display structure of the present invention.

As shown in FIGS. 7 and 8, the described structure and components provide a media display of high density and visibility of the content of each pocket. The basic design parameters of a display of the invention are set primarily by the number of tiers formed in the end panels 14, and the angular variation of the tiers with respect to the horizontal and vertical edges of the end panels. In the described embodiment with the tiers canted forward, the visibility of the media in the foremost position in any particular pocket is optimized by the angular orientation of the pockets resulting from the angular orientation of the tiers. In these embodiments, the pockets of the lower tiers are canted forward but generally more upright than the pockets of the higher tiers, canted forward a greater degree to optimally position media therein for viewing by a person standing in front of the display. The width of the pockets can be easily adjusted by sliding the pocket halves within the shelf channels. Pocket halves can be disengaged from the shelves by sliding out the open ends of the channels, or by rotation sufficient to displace the pocket mounting flange 62 from the pocket receiving channel 48. The bottom shelf 20 provides an additional area for display of media or objects that do not fit within the pockets.

FIG. 8 illustrates an alternate embodiment of the display structure 10 wherein the pockets are formed by one piece bilaterally divided pockets 70, arranged upon the shelves 40 with end pockets 72 to similarly provide a plurality of angularly tiered pockets. The engagement and support of the divided pockets 70 and end pockets 72 with the shelves 40 is the same as described above. Other pocket configurations may be used in connection with the shelves 40.

Although the media display structure is described with reference to certain preferred and alternate embodiments, modifications and variations of the basic principles set forth herein are all within the scope of equivalents of the invention. For example and without limitation, the end panels can be selectively designed and dimensioned to support any number of rows of shelves in different angularly tiered arrangements. Also, the angular variation of the tiers may be linear or non-linear, tilted toward or away from the front of the display, or the angle of a particular row adjusted by modification of the end panels, the shelf or the pocket. These and other modifications are all within the scope of the invention as defined by the claims and equivalents thereto.

What is claimed is:

1. A media display structure comprising:

a frame having a plurality of tiers for supporting a plurality of channeled shelves in an angularly tiered arrangement wherein an angle of orientation of one channeled shelf relative to a horizontal base of the frame is different from an angle of orientation of another channeled shelf relative to the horizontal base of the frame, the channeled shelves configured for engagement with a plurality of cooperating pocket halves, the pocket halves being laterally opposed upon the shelves to form separate media supporting pockets oriented upon the display according to the angular orientation of the corresponding channeled shelf.

2. The media display structure of claim 1 wherein the frame further comprises laterally opposed end panels connected by at least one rail, the end panels comprising tiers configured to support channeled shelves.

3. The media display structure of claim 2 wherein the tiers of the end panels comprise a shelf supporting segment and a channel receiving segment.

4. The media display structure of claim 3 wherein the shelf supporting segment of one of the tiers of the opposed end panels is at an angle relative to horizontal edges of the end panels, and the shelf supporting segment of another tier of the opposed end panels is at a different angle relative to the horizontal edges of the end panels.

5. The media display structure of claim 1 wherein the channeled shelves comprise a lower pocket receiving channel and an upper pocket flange receiving channel.

6. The media display structure of claim 5 wherein the channeled shelves further comprise an inverted channel at a forward edge of the lower pocket receiving channel.

7. The media display structure of claim 5 wherein the channeled shelves further comprise a downwardly extending lip on the upper pocket flange receiving channel.

8. The media display structure of claim 1 wherein the channeled shelves comprise flanges for attachment to the frame.

9. The media display structure of claim 1 wherein the pocket halves comprise a base panel generally orthogonally connected to a front panel, a side panel and a rear panel, and further comprise a foot extending from the base panel, and a pocket mounting flange extending from the rear panel.

10. The media display structure of claim 1 wherein pocket halves are joined together along the side panels.

11. The media display structure of claim 9 wherein an interior edge of the pocket mounting flange is chamfered.

12. An assembly for supporting and displaying objects, the assembly comprising:

a frame having two opposed end panels connected by rails, each end panel having a generally horizontal bottom edge on which the frame rests, a generally vertical back edge, and a front edge having a plurality of tiers of similar configuration but different angular orientation with respect to the horizontal edge or vertical edge of the panel, the tiers configured to support channeled shelves, and pockets configured to be engageable with the channeled shelf for supporting and displaying objects within the pockets.

13. The assembly of claim 12 wherein the tiers of the end panels are vertically spaced a distance greater than a height dimension of the pockets engageable with the shelves.

14. The assembly of claim 12 wherein the tiers include a shelf supporting segment and a channel supporting segment.

15. The assembly of claim 12 wherein each of the channeled shelves include a pocket receiving channel and a pocket flange receiving channel.

16. The assembly of claim 12 wherein the channeled shelves further include an outward flange at a lowest point of the channel, positionable within the frame to contact a top surface of the pocket flange receiving channel of a shelf in a tier immediately below.

17. The assembly of claim 12 wherein the pockets are comprised of pocket halves, each pocket half including a base panel connected to a front panel, rear panel and side panel, a foot extending from the base panel and dimensioned to be received within a channel of a channeled shelf, and a flange extending from the rear panel and dimensioned to be received within a channel of the channeled shelf.

18. An angularly tiered retail display structure comprising a frame having opposed end panels, each end panel having a bottom edge, a back edge and a front edge with multiple tiers, each tier being at a different angle relative to the bottom edge, each tier configured to support a product bearing assembly, the product bearing assembly including a channeled shelf having a pocket receiving channel and a pocket flange receiving channel adapted to be engaged with portions of cooperating pocket halves which form individual pockets, whereby products can be displayed within the individual pockets in tiered rows at different angles throughout the vertical extent of the display.

19. An angularly tiered structure adapted to display a plurality of rectangular three-dimensional products, the structure comprising:

a frame having opposed end panels, each end panel having a generally horizontal bottom edge on which the frame rests, a generally vertical back edge and a front edge having a plurality of tiers, a first tier being at a first angle relative to the bottom edge, the first tier being adapted to support a product bearing assembly in a first canted forward position, a second tier being at a second angle relative to the bottom edge, the second tier being adapted to support a product bearing assembly in a second canted forward position, the second angle being different from the first angle, whereby products are displayed in the first tier at one angle and in the second tier at a different angle from the first tier, and a product bearing assembly comprising a first pocket half and a second pocket half, said first pocket half and said second pocket half being slidably secured to the tier, whereby the first pocket half cooperates with the second pocket half to provide adjustable spacing between said first pocket half and said second pocket half.

20. The structure of claim 19 wherein each said pocket half is adapted to support an upper extreme outer corner of the rectangular three-dimensional product.

* * * * *